United States Patent [19]

Auth et al.

[11] 3,948,384

[45] Apr. 6, 1976

[54] TRANSPORTATION DEVICE FOR CHILLING GOODS IN COOLING TUNNELS

[75] Inventors: Franz Auth, Bischofsheim; Walter Spahn, Frankfurt am Main, both of Germany

[73] Assignee: Messer Greisheim GmbH, Frankfurt am Main, Germany

[22] Filed: Dec. 5, 1974

[21] Appl. No.: 529,697

[30] Foreign Application Priority Data

Dec. 22, 1973 Germany ..... 2364376

[52] U.S. Cl. ..... 198/229

[51] Int. Cl.[2] ..... B65G 47/42

[58] Field of Search ..... 198/219, 218, 229

[56] References Cited

UNITED STATES PATENTS

| | | | |
|---|---|---|---|
| 1,675,949 | 7/1928 | McKee | 198/219 X |
| 1,965,868 | 7/1934 | Vickers | 198/219 |
| 2,930,333 | 3/1960 | Leeuwrik | 198/219 X |
| 3,554,363 | 1/1971 | Elineau | 198/219 |

FOREIGN PATENTS OR APPLICATIONS

| | | | |
|---|---|---|---|
| 1,072,192 | 12/1959 | Germany | 198/219 |
| 1,026,686 | 1/1955 | Germany | 198/219 |

*Primary Examiner*—Allen N. Knowles
*Assistant Examiner*—Hadd Lane
*Attorney, Agent, or Firm*—Connolly and Hutz

[57] ABSTRACT

A transportation device for conveying large volume and heavy goods to be cooled in cooling tunnels is characterized by a stationary grate mounted to the tunnel floor with supports for this grate located at intervals with respect to each other parallel to the direction of conveyance, and a movable grate having its supports disposed between the supports of the stationary grate with the movable grate driven in a closed curve or loop in a vertical plane parallel to the direction of conveyance in such a manner that the supporting surfaces of the movable grate are substantially above the supports of the stationary grate when moved in the conveying direction but are substantially below the supports of the stationary grate when moved against the direction of conveyance.

2 Claims, 3 Drawing Figures

TRANSPORTATION DEVICE FOR CHILLING GOODS IN COOLING TUNNELS

BACKGROUND OF THE INVENTION

The invention relates to a transportation device for chilling heavy goods of great volume in freezing tunnels.

The transportation of goods for chilling in cooling tunnels has been taken care of up to now with the help of variously formed conveyer belts. Thus, for example, sieve-like pierced conveyer belts of elastic steel are being used, which run on rolls. Also jointed-band conveyers of different construction are being used. However, such transportation devices are suitable only for the conveyance of small and light goods to be chilled. Large goods to be cooled, e.g. automobile wrecks, which are supposed to be brought to a shredder device, cannot be transported with them, or can be transported only with difficulty. Thin, sieve-like pierced conveyer bands and light jointed band conveyers would be damaged within a short time by such chilled goods, and destroyed. Although a strong and dense jointed-band actually does not have these disadvantages, such arrangements cause in operation high friction losses. A general disadvantage of the transportation devices being used today consists in the fact that slide bearings and in part even driving and speed-increaser drives, are exposed to the low temperatures prevailing in cooling tunnels. This leads often to premature wear and tear and requires expensive special material.

SUMMARY OF INVENTION

An object of this invention is to create a transportation device in cooling tunnels by which large-volume and heavy goods can be conveyed for chilling, and which does not require any sliding parts, rubbing upon each other within the cooling tunnel.

This is accomplished according to the invention by a grate built in firmly or permanently mounted on the tunnel bottom, which "grate" consists of carrier supports arranged at a distance to each other, parallel to the direction of conveyance; additionally a movable grate is provided whose carrier supports are arranged in the interspaces between the carriers of the stationary or permanently mounted grate, the movable grate being arranged so movably that the movable grate can describe by means of a drive system a closed curve in a vertical plane, parallel to the direction of conveyance, whereby the supporting surfaces of the carriers of the movable grate, upon the movement in the direction of conveyance, are moved substantially above the supporting surfaces of the carriers of the stationary grate.

Advantageously the curve followed by the movable grate is elliptical or egg-shaped with the longer axis parallel to the direction of conveyance. This curve can be produced by an eccentric crank of breech mechanism by which the movement of a point of the coupling of the crank arm is transferred to the movable grate. This transference can take place by draw or pressure-rods, depending upon whether the breech mechanism is arranged on the roof or under the bottom of the cooling tunnel. By the force obtained by means of draw or pressure-rods, a conveyance structure is provided within the cooling tunnel having no sliding parts rubbing on each other. Therefore, the wear and tear is relatively low.

However, also entirely different curve movements of the movable grate can be produced, e.g. rectangular ones with the help of hydraulic drives.

In operation the goods to be chilled are conveyed wherein they lie at first on the firmly built-in or stationary grate. As soon as the supporting surfaces of the movable grate move toward above and in the direction of conveyance, the goods to be chilled come to lie on the movable grate, one piece is moved in the direction of conveyance and finally deposited again on the stationary grate. Then the process is repeated again. In this manner, the goods to be chilled are not moved at a uniform rate through the cooling tunnel, but rather in intervals with rest pauses in between.

In a preferred embodiment of the invention there is on each of the four corners of a rectangular a drawbar rigidly fastened to the movable grate which drawbars are led through a longitudinal slit through the roof of the cooling tunnel, and are flexibly coupled connnected therewith an eccentric push-couple drive. The four push-couple drives must be driven synchronically with this type of arrangement which can be done with chains via a mutual drive. The movable grate can extend thereby over the entire tunnel length, so that the tunnel has to be broken through or slit only at a total of four places for the drawbars.

However, also several short movable grates can be provided in the tunnel, so that the tunnel can be composed of segments. In this alternative a synchronous drive of the individual segments is suitable although not absolutely required.

It is very advantageous to provide brushes at the lower side of the movable grate so that these sweep over the bottom of the tunnel at the backward movement of the grate. Thus all small parts, which drop through the grates are swept back to the entrance of the tunnel, the tunnel is therefore self-cleaning.

THE DRAWINGS

DETAILED DESCRIPTION

Figure 1:
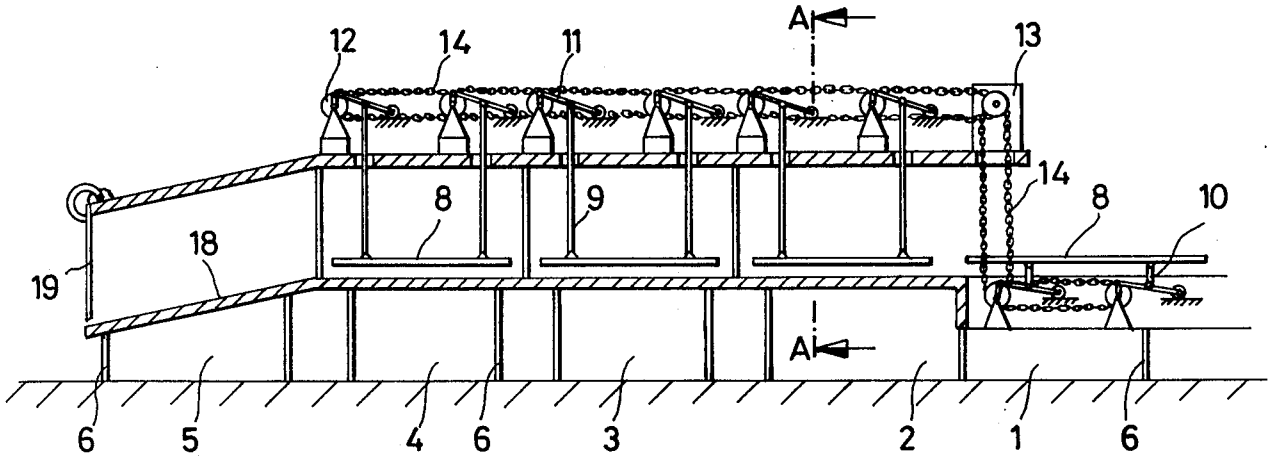
FIG. 1 illustrates a cooling tunnel with the transportation device according to the invention in a simplified representation.

The cooling tunnel shown in FIG. 1 is composed of segments 1 to 5, and segment 1 serves for the feeding of the goods to be cooled, the segments 2 and 3 for the precooling, segment 4 for the cooling proper, and the segment 5 for the discharge. The cooling in segment 4 takes place by spraying liquid nitrogen, although the spraying system is not shown in the drawing since it is of known construction. It is to be understood that the invention is not restricted to nitrogen as cooling agent, but can be used with other cooling systems.

The individual segments rest on supports 6. Each segment, except segment 5 for the discharge, is provided according to the invention with a firmly built-in or stationary grate 7 and a movable grate 8. For the sake of clarity of understanding in visualizing movable grate 8, the stationary grate is not presented in FIG. 1.

In the segments 2, 3 and 4, the movable grates 8 are rigidly connected from above with draw-rods 9, but in segment 1 grates 8 are rigidly connected from below with pressure rods 10. The draw-rods 9 and the pressure rods 10 are connected respectively flexibly or pivotally in a known manner with the couple or crank arm 11 of eccentric crank of breech mechanism 12.

Figure 2:
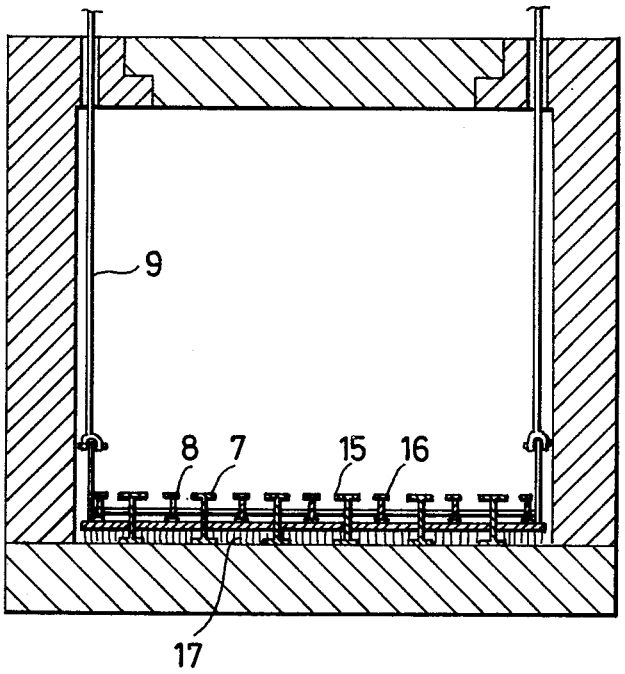
FIG. 2 is a cross-sectional view along the line A—A in FIG. 1.
Figure 3:
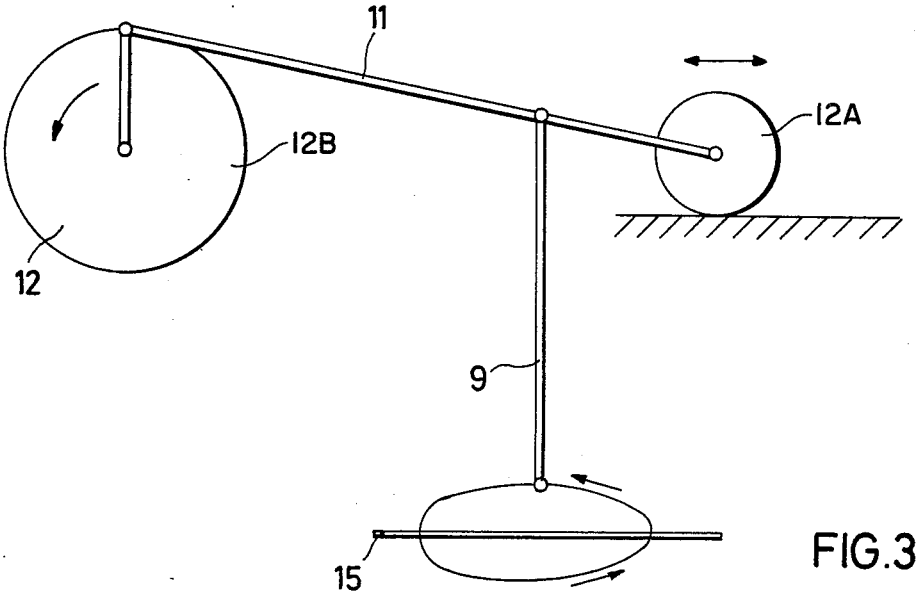
FIG. 3 illustrates diagrammatically the eccentric crank of breech mechanism in accordance with this invention.

As schematically shown in FIG. 3, the drive mechanism includes a crank arm (i.e. link) 11 mounted at one end to the central axis of a reciprocating wheel 12A. The other end of the couple or crank arm 11 is eccentrically mounted to the periphery of the rotating drive wheel 12B. As the drive wheel 12B rotates the crank arm causes the reciprocating wheel 12A to move back and forth. In this respect during rotation of drive wheel 12B the end of crank arm or link 11 connected thereto likewise follows a circular path by virtue of its connection as that end. As link or crank arm 11 is moving to the left, as shown in FIG. 3, the opposite end of link 11 connected to reciprocating wheel 12A causes the reciprocating wheel to also move to the left. Since link 11 is axially connected to reciprocating wheel 12A, reciprocating wheel 12A moves linearly, that is in a straight line. When the end of link 11 connected to drive wheel 12B begins to move toward the right as shown in FIG. 3, reciprocating wheel 12A is thus likewise caused to move toward the right thus resulting in a straight line back and forth motion of reciprocating wheel 12A. Connected flexible to the crank arm at a point intermediate the two wheels 12A, 12B is transmission arm or rod 9 to which the movable grate is connected (FIG. 2). Because of this manner of connection the rotating motion of one end of the crank arm and the reciprocating motion of the other end is transmitted as a closed loop of egg-shaped form to the support surfaces 15 of the movable grate. In other words as shown in FIG. 3 since rod 9 is connected intermediate rotating wheel 12B and linearly moving wheel 12A the resultant motion imparted to the remote end of rod 9 is a combination of these two motions or the egg-shaped form illustrated therein. Rod 9 is connected to crank 11 and grate 8 in such a manner that surfaces 15 are maintained horizontal through their movement. This drive mechanism is referred to hereinafter as an eccentric crank-of-breech mechanism.

The crank of the breech mechanisms of each side are connected with each other by a chain 14, and are driven synchronously by drive 13. Each movable grate 8 performs upon movement of the crank of breech mechanism 12 an egg-shaped movement, which is schematically illustrated in FIG. 3. The grates are adjusted thereby so that upon passage through the front and back dead points or extremities at the ends of the long axis of the egg-shaped curve, the supporting surfaces 15 of the stationary grate 7 are at the same height as the supporting surfaces 16 of the movable grate. This situation is illustrated in FIG. 2 which also illustrates how the supporters of the movable grate 8 are placed between the support surfaces of the stationary grate 7. At the lower side of the movable grate 8 brushes 17 are mounted for the self-cleaning of the cooling tunnel by brushing backward anything dropping through the supports of grate 7. Thus at each lift movement of the movable grate 8 by the crank of breech mechanism 12, goods to be cooled, lying on the support surfaces of the stationary grate 7 are lifted by the movable grate 8 and moved forward a distance of the egg-shaped curve major axis in the direction of the tunnel discharge and deposited again on downstream support surfaces of stationary grate 7. This process is repeated continuously, so that the goods to be chilled are conveyed through the tunnel being cooled. Finally, the goods or workpieces reach the discharge slope 18 and slide down slope 18 to open the discharge flap 19 by their own weight and thereby exit the cooling tunnel. In section 5 of the tunnel the sloping surface 18 functions as a stationary conveyer to receive the goods from grate 8.

The transportation device according to the invention is of particular advantage because of its mechanical sturdiness, so that heavy goods and goods of large volume, e.g. whole automobile wrecks, can be transported without difficulties. Thus, practically without interruptions of the operation it is possible to wait until all workpieces are outside of the cooling tunnel. Moreover, by the provision of the brushes 17 the cooling tunnel is self-cleaning.

What is claimed is:

1. A transportation device for conveying large volume and heavy goods to be cooled in cooling tunnels comprising, in combination, an elongated cooling tunnel having an entrance end and a discharge end defining a direction of conveyance from said entrance end to said discharge end, a stationary grate mounted in said tunnel, said stationary grate having support surfaces arranged at intervals to each other along said direction of conveyance for supporting the goods to be cooled, a movable grate having support surfaces arranged at intervals to each other and located for being disposed between said support surfaces of said stationary grate, drive means for moving said support surfaces of said movable grate along a closed loop in a vertical plane parallel to said direction of conveyance in a forward direction along said direction of conveyance and in a rearward direction opposite said direction of conveyance, said support surfaces of said movable grate in said rearward direction being disposed below the level of said stationary grate support surfaces whereby the goods are thereby supported by said stationary grate, said support surfaces of movable grate in said forward direction being above the level of said stationary grate support surfaces whereby the goods are lifted from said stationary grate and transported forward by said movable grate, said closed loop being egg-shaped with its major axis being parallel to said direction of conveyance, said drive means including an eccentric crank-of-breech mechanism, a downwardly extending draw-rod being connected at each of the four corners of said movable grate, said draw rods being rigidly connected to said grate and flexibly connected to the crank arm of said mechanism, said mechanism being mounted to the roof of said tunnel, said tunnel comprising a plurality of segments, and a movable grate being mounted in each segment each with its drive means, said drive means being interconnected for mutual synchronous movement, said drive means interconnected by chain means, said segments including an entrance segment, said movable grate means at said entrance segment having its drive means mounted to the floor of said tunnel and connected to its movable grate by upwardly extending push rods, said tunnel having a downwardly sloping surface at said discharge end, and cleaning brush means being mounted at the lower side of said movable grates disposed for sweeping the floor of said tunnel in said rearward direction.

2. A transportation device for conveying large volume and heavy goods to be cooled in cooling tunnels comprising, in combination, an elongated cooling tunnel having an entrance end and a discharge end defining a direction of conveyance from said entrance end to said discharge end, a stationary grate mounted in said tunnel, said stationary grate having support surfaces arranged at intervals to each other along said direction of conveyance for supporting the goods to be cooled, a movable grate having support surfaces arranged at intervals to each other and located for being disposed between said support surfaces of said stationary grate, drive means for moving said support surfaces of said movable grate along a closed loop in a vertical plane parallel to said direction of conveyance in a forward direction along said direction of conveyance and in a rearward direction opposite said direction of conveyance, said support surfaces of said movable grate in said rearward direction being disposed below the level of said stationary grate support surfaces whereby the goods are thereby supported by said stationary grate, said support surfaces of movable grate in said forward direction being above the level of said stationary grate support surfaces whereby the goods are lifted from said stationary grate and transported forward by said movable grate, and cleaning brush means being mounted to the lower side of said movable grate for sweeping the floor of said tunnel in said rearward direction.

* * * * *